US006631674B2

(12) United States Patent
Hara et al.

(10) Patent No.: US 6,631,674 B2
(45) Date of Patent: Oct. 14, 2003

(54) STENCIL PRINTING MACHINE AND CONTROL METHOD THEREOF

(75) Inventors: Yoshikazu Hara, Ibaraki-ken (JP); Takeshi Koishi, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/915,258

(22) Filed: Jul. 27, 2001

(65) Prior Publication Data

US 2001/0050007 A1 Dec. 13, 2001

(30) Foreign Application Priority Data

Aug. 1, 2000 (JP) ..... P2000-233307

(51) Int. Cl.[7] ..... B41L 13/06; B41F 15/10
(52) U.S. Cl. ..... 101/116; 101/115; 101/118
(58) Field of Search ..... 101/114, 115, 101/116, 118, 128.21, 128.4, 129

(56) References Cited

U.S. PATENT DOCUMENTS 6,205,918 B1 * 3/2001 Takahashi et al. ..... 101/115
6,393,978 B1 * 5/2002 Sugawara et al. ..... 101/115
6,427,586 B2 * 8/2002 Takahashi ..... 101/116

* cited by examiner

*Primary Examiner*—Stephen R. Funk
(74) *Attorney, Agent, or Firm*—Nath & Associates PLLC; Marvin C. Berkowitz

(57) ABSTRACT

On each of plural printing drums (25, 26) in a stencil printing machine (1), a stencil sheet (11) made corresponding to printing data is rolled. The machine (1) for a stencil printing process, in which a printing paper is pressed on each printing drum and the used stencil sheet is disposed, has a mode designation section (101) and a controller (102). The section (101) designates whether or not a stencil printing process is performed for plural printing information including common printing data. The control section (102) controls the stencil making process, the stencil disposing process, and the stencil printing process for the printing information. When the printing information includes common printing data, the controller (102) controls the printing drum on which the stencil sheet for the common printing data is rolled so that the stencil making and disposal processes are not performed.

8 Claims, 6 Drawing Sheets

STENCIL PRINTING MACHINE AND CONTROL METHOD THEREOF

CROSS-REFERENCE TO RELATED APPLICATION

This application claims benefit of priority under 35 USC §119 to Japanese Patent Application No. P2000-233307, filed on Aug. 1, 2000, the entire contents of which are incorporated herein by reference.

BACKGROUND OF THE INVENTION

1. Field of the Invention

The present invention relates to a stencil printing machine having a plurality of printing drums, each printing drum sets a stencil sheet rolled thereon, which is made based on printing data, and for performing a stencil printing process by pressing a printing paper on each printing drum, and disposing the used stencil sheet from the printing drums, and more particularly, to a stencil printing machine and method capable of efficiently performing the printing process of plural printing information by controlling a stencil making process and a stencil disposal process per printing drum.

2. Description of the Related Art

In a stencil printing machine having plural printing drums capable of performing mono-color and multi-color printing process, a first printing drum, a second printing drum and a pressure drum are fixed rotatably in the machine, and each of the first and second drums are placed closely at the outer peripheral surface of the pressure drum separated to each other in approximately a 90 degree angle around the center of the pressure drum.

When the stencil printing machine performs the stencil printing process, firstly, a stencil clamp section in each of the first and second stencil drums clamps the leading edge of the stencil sheet made by two-color (printing) data, first and second colors, in order to set it on a screen outer-peripheral surface of each stencil drum. After this, a printing paper is fed (printing operation) between the first stencil drum and the pressure drum from a paper feed section in the synchronous rotation among the first stencil drum, the second stencil drum, and the pressure drums. Thereby, the printing paper fed from the paper feed section is clamped by a paper clamp section in the pressure drum, and transferred between the first stencil drum and the pressure drum along the outer peripheral surface. In this process, the first color ink is transferred through perforations in the stencil sheet onto the printing paper.

After the completion of the permeation of the first color ink, the printing paper is then fed by the paper feed section between the second stencil drum and the pressure drum in order to print the second color ink through perforations in the stencil sheet onto the printing paper, based on the same principle of the printing process for the first color ink.

Finally, a paper delivery section delivers the printed sheet on which the desired printing image data have been printed to a desired position and the multi-color printing process is thereby completed.

In the conventional stencil printing machine having the configuration described above, the stencil sheets rolled on all the printing drums must be disposed per different printing process. For example, as shown in FIG. 5, when printing data T50*a* to T50*d* including a common printing data item T51 are printed, the stencil sheets having the common printing data item T51 are also disposed and the stencil making process is performed again. The conventional machine consumes many stencil sheets. It is a waste of the stencil sheets. In addition to this conventional drawback, because the common printing data item that has been made on the stencil sheet is made on a stencil sheet again. This process becomes a time consuming and requires a waste of time. That is, the conventional stencil printing machine has a very low efficiency.

SUMMARY OF THE INVENTION

Accordingly, an object of the present invention is, with due consideration to the drawbacks of the conventional technique, to provide a stencil printing machine and a control method capable of performing a stencil printing process for a plurality of printing information including common printing data.

In accordance with an embodiment of the present invention, a stencil printing machine and a control method has a plurality of printing drums. On each printing drum, a stencil sheet made based on printing data is rolled. The stencil printing machine performs a stencil printing process by pressing a printing paper delivered on each printing drum and disposes a used stencil sheet from each printing drum. This stencil printing machine comprises a mode designation section and a control section. The mode designation section designates operation modes regarding whether or not the stencil printing process is a process of a plurality of printing information including common printing data. The control section controls operations of a stencil making process, a stencil disposal process, and a stencil printing process for the printing information according to the instruction through the mode designation section. The control section controls that both the stencil disposal process and the stencil making process are not performed for the printing drum on which the stencil sheet made for the common printing data is rolled when the stencil printing process of the plurality of printing information including the common printing data is designated.

By this configuration, when the printing process for the plural printing information including the common printing data is performed, both the stencil disposal process and the following stencil making process are performed only for the printing drums other than the printing drum for the common printing data. Accordingly, it is therefore possible to keep the consumption of the stencil sheet as low as possible and also possible to reduce the entire operation time of the stencil printing process.

In the stencil printing machine, it is desirable to set the printing drum for the common printing data nearest to the paper feed section. It is thereby possible to prevent the occurrence of re-transfer of the ink to the printing paper, that has been transferred on the printing drum far away from the paper feed section.

In addition, it is desirable that the control section comprises a judgment section to judge whether or not the plural printing information include common printing data.

In accordance with another embodiment of the present invention, a stencil printing machine and a control method has a plurality of printing drums. On each printing drum, a stencil sheet made based on printing data is rolled. The stencil printing machine performs a stencil printing process by pressing a printing paper delivered on each printing drum and disposes a used stencil sheet from each printing drum. This stencil printing machine comprises a mode designation section and a control section. The mode designation section designates the printing drum to which a stencil disposal process and a stencil making process are not performed. The control section controls operations of the stencil making process, the stencil disposal process, and a stencil printing process according to the instruction designated through the mode designation section. The control section controls that both the stencil disposal process and the stencil making process are not performed for the printing drum designated by the mode designation section.

According to the configuration described above, both the stencil disposal process and the stencil making process are performed only for desired printing drums that are designated, and the stencil printing process is performed by using all printing drums. It is therefore possible to minimize the consumption of the stencil sheet and to realize the process of the stencil printing process efficiently.

BRIEF DESCRIPTION OF THE DRAWINGS

These and other objects, features, aspects and advantages of the present invention will become more apparent from the following detailed description of the present invention when taken in conjunction with the accompanying drawings, in which.

DETAILED DESCRIPTION OF THE PREFERRED EMBODIMENTS

Other features of this invention will become apparent through the following description of preferred embodiments which are given for illustration of the invention and are not intended to be limiting thereof.

A description will be given of the stencil printing machine and control method capable of performing a stencil printing process for a plurality of printing information including common printing data with reference to FIGS. 1 to 4.

<Configuration of the Stencil Printing Machine>

First, the configuration of the stencil printing machine will be explained with reference to FIG. 1.

Figure 1:
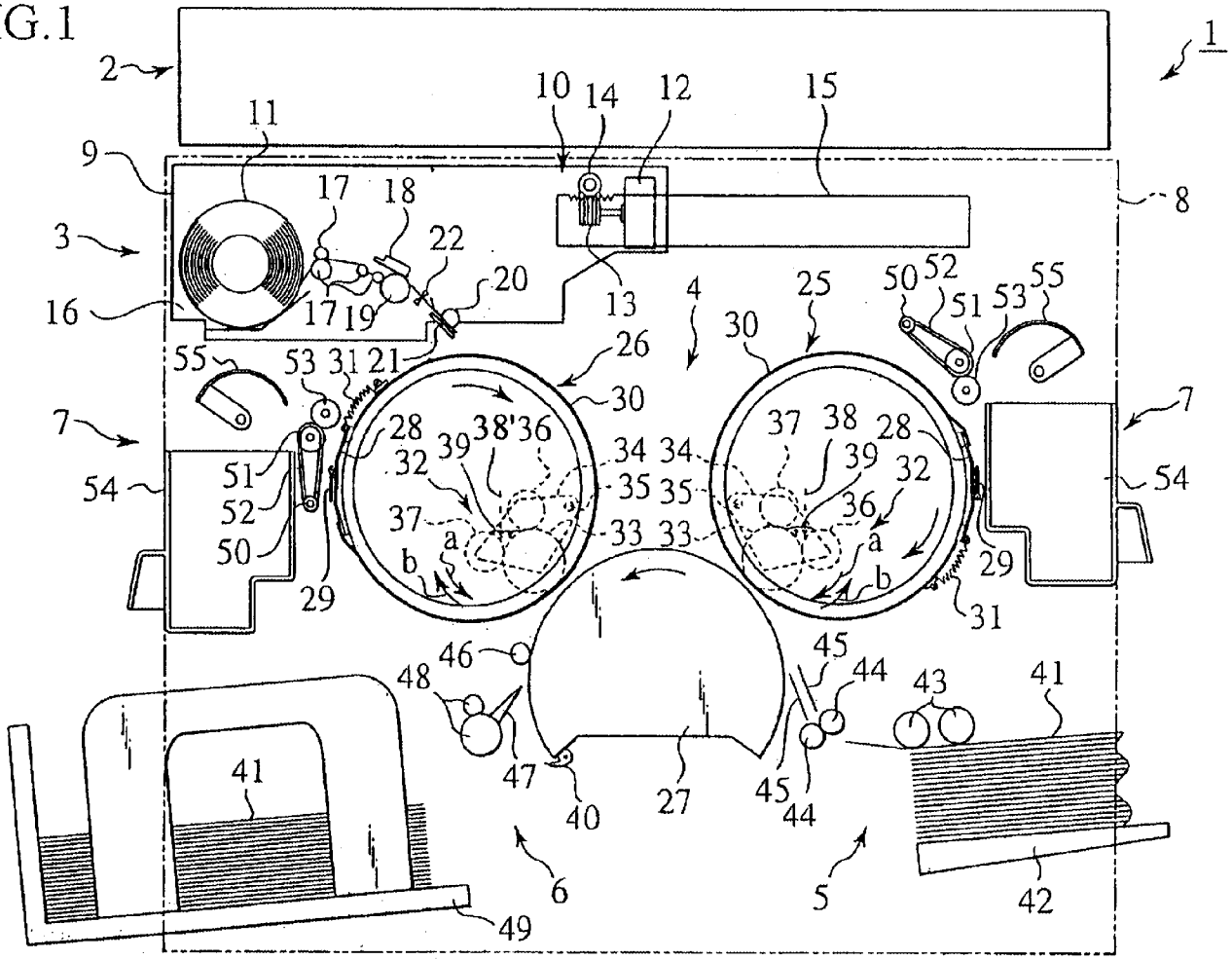
FIG. 1 is a schematic diagram showing a configuration of the stencil printing machine according to the embodiment of the present invention.

As shown in FIG. 1, the stencil printing machine according to embodiments of the present invention mainly comprises a document reading section 2, a stencil making section 3, a printing section 4, a paper feed section 5, a paper delivery section 6, and a pair of stencil disposal sections 7.

(Document Reading Section 2)

The document reading section 2 is mounted on the upper section of the body 8 of the stencil printing machine 1. The document reading section 2 reads a document to be printed and transforms it to electrical signals. The document information that has been read ink generated as each image data for the first printing drum color is and a second printing drum color ink. These image data can be processed according to desired instructions such as scaling instructions (scale up and down).

(Stencil Making Section 3)

The stencil making section 3 has a stencil making unit 9, mounted on the body 8 of the stencil printing machine 1, which can be movable in lateral direction. The stencil making unit 9 is moved between a first stencil supply position and the second stencil supply position by the stencil making unit moving means 10. Here, the stencil sheet 11 is supplied to the first printing drum 25 at the first stencil supply position, and the stencil sheet 11 is also supplied to the second printing drum 26 at the second stencil supply position by the stencil making unit moving means 10.

The stencil making unit moving means 10 comprises a stencil making unit moving motor 12 fixed at the stencil making unit 9, a worm gear 13 fixed at a rotation axis of the stencil making unit moving motor 12, a worm wheel (not shown) engaged with the worm gear 13, a pinion gear 14 fixed at the coaxial axis of the worm wheel, and a rack 15 fixed to the body 8 side.

The stencil making unit 9 comprises a stencil sheet containing section 16, a plurality of transfer rollers 17, a thermal head 18, a platen roller 19, a stencil sheet feed roller 20, a guide plate 21, and a stencil sheet cutter 22.

The stencil containing section 16 contains a long stencil sheet 11 that has been rolled. Each transfer roller 17 guides the leading edge of the stencil sheet 11 contained in the stencil sheet containing section 16 toward the downstream of the transmission. The thermal head 18 is placed at the downstream side of the transfer rollers 17. The platen roller 19 is placed at the opposition side of the thermal head 18 and rotates by the driving force of the write pulse motor (not shown). The stencil sheet feed roller 20 is placed at the downstream side of the transmission direction of the stencil sheet 11 against the position of the write pulse motor (not shown) and the thermal head 18 and rotates by the driving force of the write pulse motor.

The guide plate 21 is pressed by the stencil sheet feed roller 20. The stencil sheet cutter 22 is placed between the guide plate 21, the platen roller 19, and the thermal head 18.

(Printing Section 4)

The printing section 4 has the first printing drum 25, the second printing drum 26, and the pressure drum 27. Both the first and second printing drums 25 and 26 are placed at the upper positions in a right slanting direction and left slanting direction, respectively. In more particularly, the first printing drum 25 and the second printing drum 26 are placed at positions close to the outer peripheral surface of the pressure drum 27 and separated to each other by a 90 degree angle.

Both the first and second printing drums 25 and 26 and the pressure drum 27 are mounted rotatably and independently. A printing drum rotation mechanism (not shown) controls that the first and second printing drums 25 and 26 and the pressure drum 27 rotate with a same peripheral velocity at each of the closed and pressed positions of the outer peripheral surface. A main motor (not shown) drives this printing drum rotation mechanism.

In each of the first and second printing drums 25 and 26, a stencil clamping base 28 connects right and left ring-shaped frames (not designated using reference numbers) that are supported rotatably. That is, this stencil clamping base 28 forms a part of the outer peripheral surface of each of the first printing drum 25 and the second printing drum 26. In the stencil clamping base 28, a stencil clamping section 29 is formed in order to clamp the leading edge of the stencil sheet 11.

The leading edge of each screen 30 is fixed to each stencil clamping base 28 in each printing drum and the screen 30 is rolled around the outer peripheral surface of each of the first and second printing drums 25 and 26.

The trailing edge of each screen 30 is forcedly set on each stencil clamping base 28 through a spring 31. The screen 30 can be shifted to outside against the force of the spring 31. Each screen 30 in each printing drum has a mesh structure body, for example. When an inner press roller 33 presses the screen 30, the ink is permeated from the inner side to the outer side of the screen 30. That is, each screen 30 forms the outer peripheral surface section of each of the first printing drum 25 and the second printing drum 26 to which the ink corresponding to each printing drum is supplied.

In the inner section of each screen 30 in each of the first and second printing drums 25 and 26, an inner press mechanism 32 is provided.

Each inner press mechanism 32 comprises the inner press roller 33 capable of supplying a printing pressure from the inner peripheral surface of the printing drum and of supplying the ink to the screen 30.

The inner press roller 33 is mounted rotatably by the roll support members 34 at the both sides, and driven by a driving means (not shown) in synchronization with the rotation of both the first and second printing drums 25 and 26.

The roll support member 34 is supported rotatably about the center of the support axis 35 and shifted between a pressure position and a standby position. At the pressure position, the inner press roller 33 presses the inner peripheral surface of the screen 30 by rotating and shifting the roll support member 34 in the direction designated by the arrow "a" (see FIG. 1). At the waiting position, the inner press roller 33 is separated from the inner peripheral surface of the screen 30 by rotating and shifting the roll support member 34 in the direction designated by the arrow "b" (see FIG. 1).

The inner press roller 33 is at the pressure position during printing process and at the standby position during other process.

A first doctor roller 36 and a second doctor roller 37 are attached to the roll support member 34.

The first doctor roller 36 and a second doctor roller 37 have a circular cylindrical shape and are placed close to the inner press roller 33.

The ink supply unit (not shown) supplies the ink to the upper space, enclosed by the first doctor roller 36 and the second doctor roller 37, in the outer peripheral space of the inner press roller 33. At this position, an ink pool 39 is formed.

The first color ink 38 is supplied to the first printing drum 25 and the second color ink 38' is supplied to the second printing drum 26.

The gap (or an opposition distance) between the first doctor roller 36 and the inner press roller 33 is so set that the thickness of the ink adhered to the inner press roller 33 is a desired thickness. In addition, the gap between the second doctor roller 37 and the inner press roller 33 is so set that the ink won't leak out. That is, when the inner press roller 33 rotates, the ink of a desired thickness is adhered to the outer peripheral surface of the inner press roller 33 continuously by the gap between the first doctor roller 36 and the inner press roller 33, and the ink is supplied to the screen 30 by the inner press roller 33.

A sheet clamping section 40 is mounted at a desired position on the outer peripheral surface of the pressure drum as a printing pressure rotation member. The sheet clamping section 40 clamps the leading edge of each of the printing papers 41 as a printing material.

(Paper Feed Section 5)

The paper fee section 5 comprises a paper feed tray 42, a first paper supply roller 43, a pair of second paper supply rollers 44, and a guide plate 45. In the paper feed tray 42, printing papers 41 as a printing medium are stacked.

The first paper supply roller 43 presses the upper most printing paper 41 toward the paper feed tray 42. The pair of second paper supply rollers 44 are placed at the downstream side of the first paper supply roller 43. The guide plate 45 guides the feeding of the printing paper between the second paper supply rollers 44 and the pressure drum 27.

Only the uppermost printing paper is fed to the pair of second paper supply rollers 44 by the rotation of the first paper supply roller 43. The printing paper 41 fed is supplied to the paper feed section 5 in synchronization with the pressure drum 27 by the rotation of the pair of the second paper supply rollers 44.

(Paper Delivery Section 6)

The paper delivery section 6 comprises an upper limit guide section 46, a paper peeler hook 47, a pair of paper delivery rollers 46, and a paper receiving tray 49. The upper limit guide section 46 guides the leading edge of the printed paper 41 on which the printing process has been completed. The paper peeler hook 47 peels the printed paper 41 away from the pressure drum 27. The pair of paper delivery rollers 48 guided by the upper limit guide section 46 delivers the printed paper 41 that has been peeled away from the pressure drum 27 by the paper peeler hook 47. The paper receiving tray 49 stacks the printed papers delivered by the pair of paper delivery rollers 48.

(Stencil Disposal Section 7)

The stencil disposal section 7 is mounted corresponding to each of the first printing drum 25 and the second printing drum 26. Each stencil disposal section 7 comprises a pair of stencil disposal rollers 50 and 51, a stencil disposal guide belt 52, a stencil disposal roller 53, a stencil sheet stocker 54, and a stencil compression plate 55. The pair of stencil disposal rollers 50 and 51 are placed so that they are slightly separated from the outer peripheral surfaces of the first and second printing drums 25 and 26. The stencil disposal guide belt 52 mounted between the pair of stencil disposal rollers 50 and 51 guides the leading edge of the stencil sheet 11 that has been released from the stencil sheet clamp section 29. The stencil disposal roller 53 conveys the stencil sheet 11 guided by the stencil disposal guide belt 52 with the stencil disposal roller 51 while peeling this the stencil sheet 11 away from the first and second printing drums 25 and 26. The stencil sheet stocker 54 stores the used stencil sheets 11 conveyed by the pair of stencil disposal convey rollers 51 and 53. The stencil compression plate 55 presses the stencil sheets 11 stacked toward the innermost of the stencil sheet stocker 54.

<Configuration of the Control System>

Next, a description will be given of the control system of the stencil printing machine according to the embodiments of the present invention with reference to FIG. 2.

Figure 2:
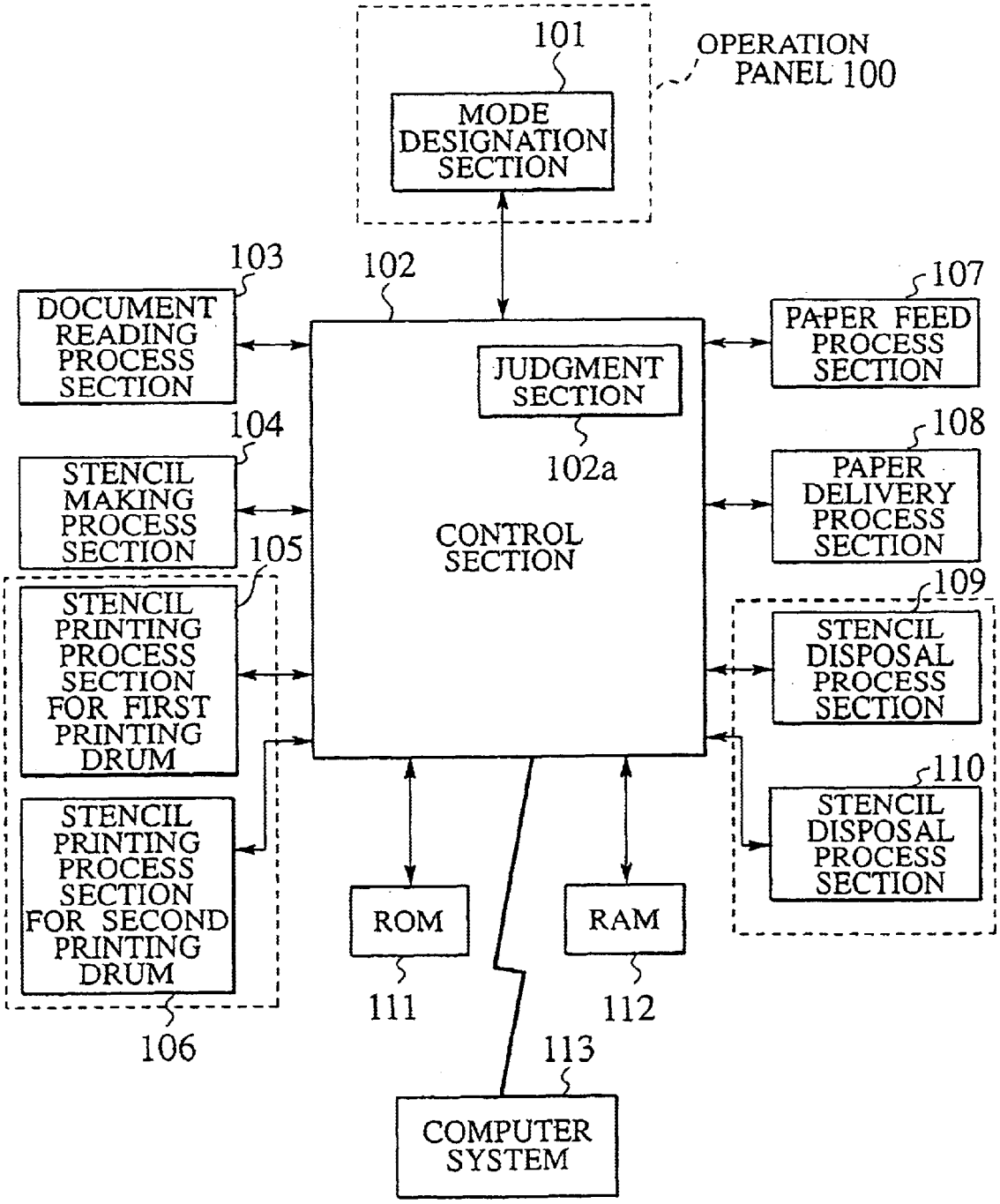
FIG. 2 is a schematic block diagram showing a configuration of a control system according to the embodiment of the present invention.

FIG. 2 is a schematic block diagram showing the configuration of the control system in the stencil printing machine according to the embodiments of the present invention;

The stencil printing machine 1 comprises an operation panel 100. The operation panel 100 comprises a mode designation section 101, a stencil making/printing start key, a ten key by which the number of printed sheets is designated, a mono-color printing key, and a display panel section for displaying various data items. Here, these are not omitted from the drawings.

As shown in FIG. 2, input data items inputted through the operation panel 100 by the user are outputted to a control section 102. The control section 102 totally manages and controls various operations of a document reading section 103, a stencil making process section 104 (corresponding to the stencil making section 3), first and second stencil printing process sections 105 and 106 (corresponding to the printing section 4), a paper feed process section 107, a paper delivery process section 108, and a pair of stencil disposal process sections 109 and 110 (corresponding to the stencil disposal sections 7).

The control section 102 controls the writing/reading operation of the ROM 111 and the RAM 112 in which various kinds of control programs are stored. In addition, the control section 102 connected to an outer computer system 113 through an electrical network in order to read image data from the computer system 113. In this configuration, it is desirable to incorporate a judgment section 102*a* in the control section 102, that judges whether a plurality of printing information include one or more common printing data.

First Embodiment.

Figure 3:
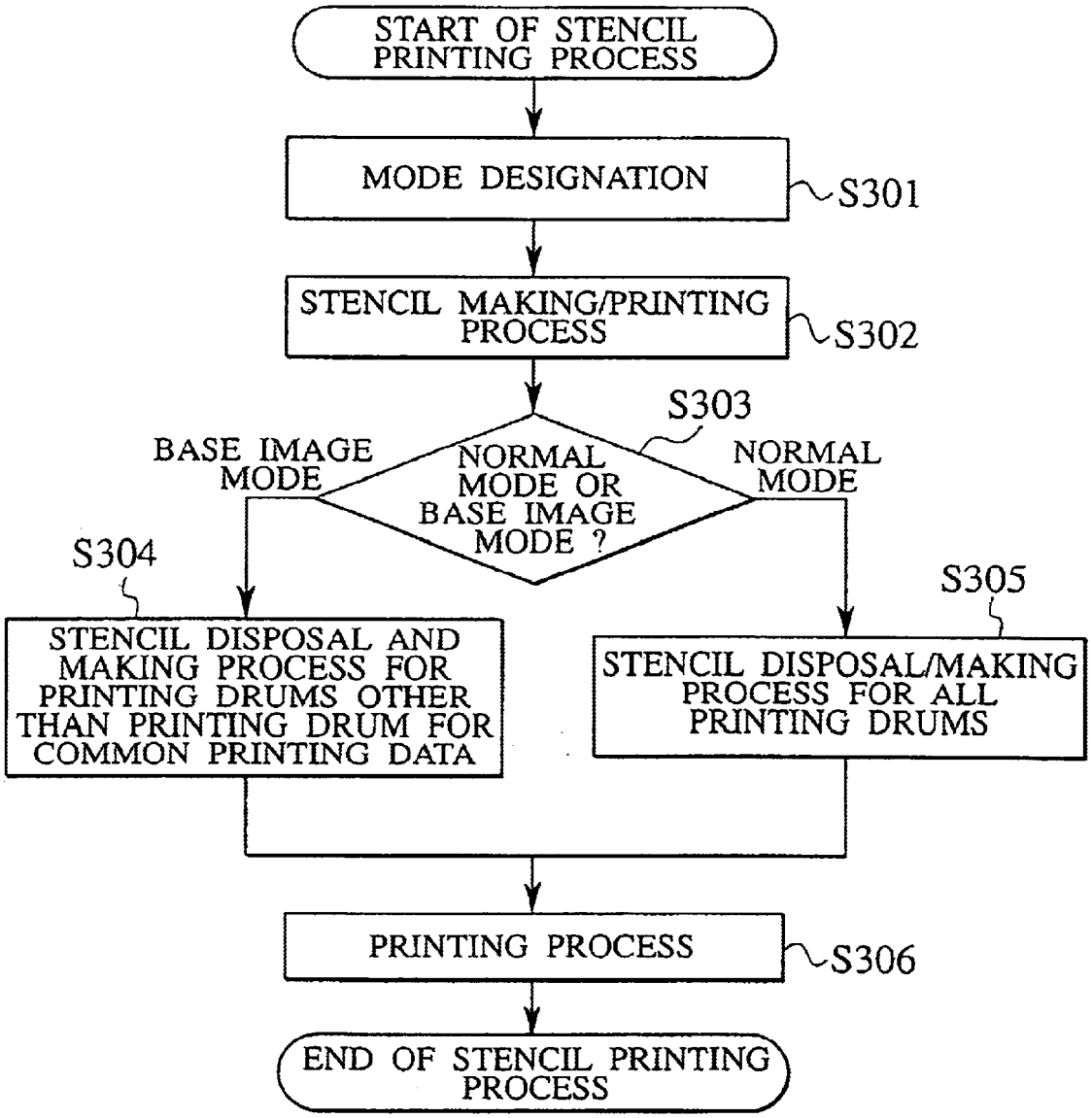
FIG. 3 is a flow chart showing a control method of the stencil printing machine according to the first embodiment of the present invention.

Next, a description will be given of the control method performed by the stencil printing machine 1 according to the first embodiment of the present invention with reference to FIG. 3.

(1-1) The user designates to perform the multi-page printing process including common printing data (base image mode) or the normal printing process (normal mode) through the mode designation section 101 (mode designation step S301).

(1-2) The stencil making process and the stencil printing process are performed for the printing information inputted (Stencil making and printing step S302).

Here, the stencil printing machine can input the printing information through reading devices of various types such as a scanner, or a computer system, or an electrical network. When the user designates the base image mode in the stencil making and printing process, it is necessary to designate the area of the common printing data in the printing information regardless of the type of the input device.

As the designation method, it is also possible to use a pointing device such as a mouse pointer, or to input one or more electrical files in which information (such as coordinates, types of characters, and other data) regarding the range of the common printing data is stored.

(1-3) The control section 102 judges whether the mode designated through the mode designation section 101 is the base image mode or the normal mode (Mode judgment step S303).

(1-4) When the base image mode is selected at Step S303, the control section 102 controls the stencil making process section 104 and the stencil disposal process sections 109 and 110 so that the stencil disposal process is not performed for the printing drum on which the stencil sheet made for the common printing data is rolled, and the stencil disposal process is performed only for the printing drum with no common printing data. After this, the control section 102 instructs the stencil making process section 104 and the stencil disposal process sections 109 and 110 to perform the following stencil making process (Stencil making step (A), S304).

(1-5) When the normal mode is selected at Step S303, the control section 102 controls the stencil making process section 104 and the stencil disposal process sections 109 and 110 so that the stencil disposal process and the stencil making process are performed for all the printing drums regardless of the presence of the common printing data made on the stencil sheets (Stencil making step (B), S305).

(1-6) Based on the printing data made in the stencil sheets on the printing drums, the first and second stencil printing process sections 105 and 106 perform the printing process (Printing process step, S306).

Thus, in the stencil printing control method according to the first embodiment of the present invention, when the multi-page printing process is designated through the mode designation section 101 in order to print the printing information including common printing data, the control section 102 controls the operation of the stencil printing process sections 105 and 106 so that the stencil disposal process and the following stencil making process are not performed for the stencil sheet in which the common printing data has been made when the multi-page printing process (base image mode) is designated by the mode designation section 101, even if the contents of following printing information are changed.

That is, in the stencil printing machine according to the embodiments, the made stencil sheet including the common printing data is not disposed from the printing drum after the completion of the first stencil making process. In the following stencil making process, only the stencil sheets including the printing data other than the common printing data are disposed and the following stencil making process is performed for them. Accordingly, it is possible to save the consumption of the stencil sheets. Further, it is possible to reduce the operation time of the stencil disposal process and the stencil making process. By using the configuration of the stencil printing machine of the embodiments, it is also possible to perform the stencil disposal process and the stencil making process to replace a failed stencil sheet by designating the printing drum corresponding to the failed stencil sheet by a user's command.

Here, it is desirable to use the printing drum, for the common printing data, which is placed closely to the paper feed section 5 (the first printing drum shown in FIG. 1). This can prevent the ink on the stencil sheet adhered on the printing drum that is far away from the paper feed section 5 from being transferred onto the printing paper.

It is desirable for the user to designate the common data region using an indication device, such as a mouse pointer, in the printing information that has been read through the reading device such as a scanner.

It is acceptable that the stencil making process is performed for all the printing drums regardless of the presence of the common printing, while the original information of the common printing data is kept as data source. In this configuration, the reading of the stencil printing data including common printing for each process can be eliminated while reading only the printing-data part to be changed. This can also reduce the operation time of the stencil making process.

Second Embodiment.

<Control Method for the Stencil Printing Machine>

Figure 4:
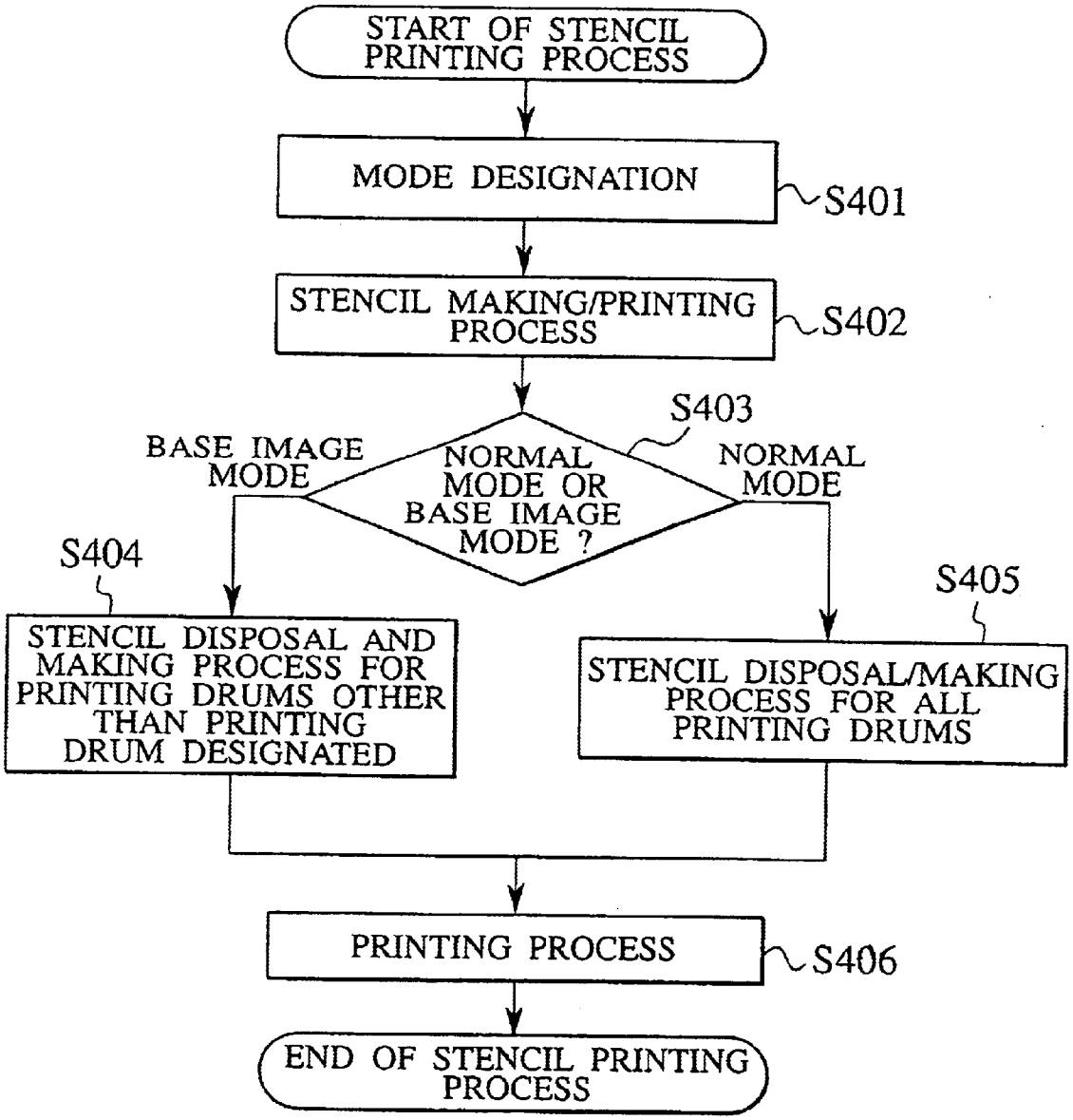
FIG. 4 is a flow chart showing a control method of the stencil printing machine according to the second embodiment of the present invention.
Figure 5:
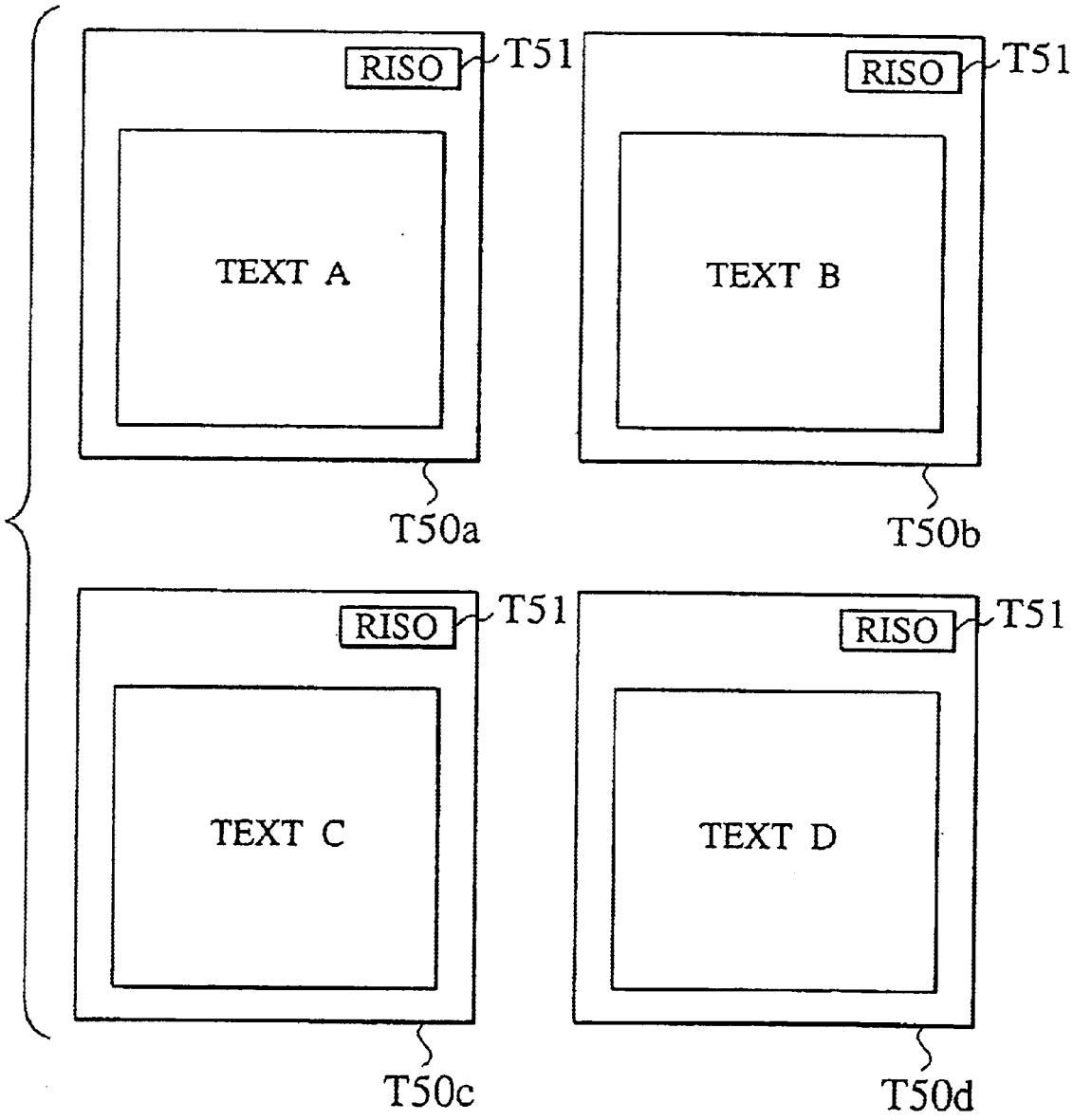
FIG. 5 is a diagram explaining printing information including common printing data.

Next, a description will be given of the control method performed by the stencil printing machine 1 according to the second embodiment of the present invention with reference to FIG. 4.

(2-1) The user designates to perform the stencil disposal process and the stencil making process only for a desired printing drum, for the multi-page printing process including common printing data (base image mode) or to perform the normal printing process (normal mode) through the mode designation section 101 (mode designation step S401).

Figure 6:
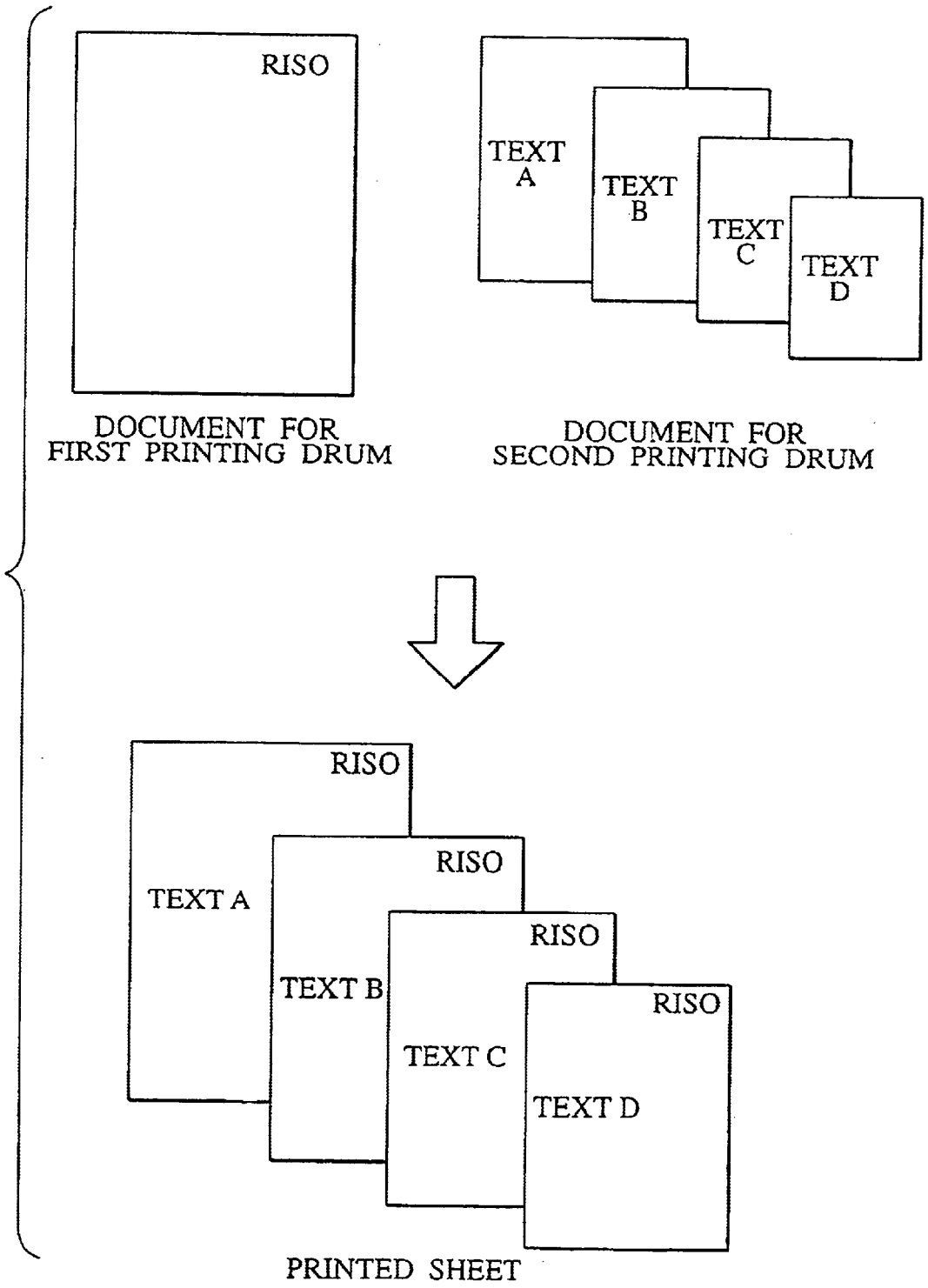
FIG. 6 is a diagram showing a stencil printing process in which printing information made on one printing drum is fixed.

(2-2) The stencil disposal process, the stencil making process, and the printing process are performed for the printing information inputted, for example "RISO" and "text A" shown in FIG. 6 (Stencil making and printing step S402).

(2-3) The control section 102 judges whether the mode designated through the mode designation section 101 is the base image mode or the normal mode (Mode judgment step S403).

(2-4) When the base image mode is selected at Step S403, the control section 102 controls the operation of the stencil making process section 104 and the stencil disposal process sections 109 and 110 so that the stencil disposal process and the stencil making process are not performed for the printing drum under the base image mode (for example, the printing drum where the text "RISO" as the common printing data is made shown in FIG. 6.), and the stencil disposal process and the stencil making process are performed for the following text (for example, "text B") in other printing drum (for example, the printing drum where "text A" was made.) (Stencil making process (A), S404).

(2-5) When the normal mode is selected at Step S403, the control section 102 controls the stencil making process section 104 and the stencil disposal process sections 109 and 110 so that the stencil disposal process and the stencil making process are performed for all the printing drums regardless of the presence of the common printing data in the made stencil sheets (Stencil making step (B), S405).

(2-6) Based on the printing data made in the stencil sheets on the printing drums, the first and second stencil printing process sections 105 and 106 perform the printing process (Printing process step, S406).

Thus, in the stencil printing control method performed by the stencil printing machine according to the second embodiment of the present invention, when the user designates the base image mode through the mode designation section 101, the control section 102 controls the operation of the stencil printing sections 105 and 106 so that the stencil disposal process and the stencil making process are not performed for the printing drum on which the stencil sheet with the common printing data is rolled, and the stencil disposal process and the stencil making process are performed for other printing drum on which the stencil sheet with the printing data other than the common printing data is placed.

That is, in the stencil printing performed by the stencil printing machine 1, after the completion of the first stencil making process, the stencil sheet for the common printing data which is rolled on the printing drum under the base image mode is not disposed, and only the stencil sheet with the printing data other than the common printing data is disposed and the following stencil making process is performed for this printing drum. It is therefore possible to save the consumption of the stencil sheets and also possible to reduce the entire operation time of the stencil printing process.

As set forth in detail, according to the stencil printing machine and the control method of the present invention, it is possible to save the consumption of the stencil sheets during the stencil printing process and reduce the entire operation time of the stencil printing process.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A stencil printing machine having a plurality of printing drums, each printing drum capable of having a stencil sheet mounted thereon wherein the stencil sheet has been made based on data to be printed, the stencil printing machine for performing a stencil printing process by pressing a printing paper delivered on each printing drum and for disposing of a used stencil sheet from each printing drum, the stencil printing machine further comprising:

a mode designation section designating operation modes including a first operating mode in which the stencil printing process is a process of a plurality of printing information including common printing data and a second operating mode in which the stencil printing process is not a process of a plurality of printing information; and a control section controlling operations of a stencil making process, a stencil disposal process, and a stencil printing process for the printing information according to an instruction from the mode designation section, wherein the control section controls that both the stencil disposal process and the stencil making process are not performed for a printing drum on which the stencil sheet made for the common printing data is mounted when the first operating mode is designated.

2. The stencil printing machine according to claim 1, wherein the control section controls that the common printing data is made on the stencil sheet mounted on the printing drum nearest to a paper feed section for feeding the printing paper.

3. The stencil printing machine according to claim 1, wherein the control section comprises a judgment section for judging whether or not the plurality of printing information include the common printing data.

4. The stencil printing machine according to claim 2, wherein the control section comprises a judgment section for judging whether or not the plurality of printing information include the common printing data.

5. A stencil printing machine control method of controlling operation of a stencil printing machine having a plurality of printing drums, each printing drum capable of having a stencil sheet mounted thereon wherein the stencil sheet has been made based on printing data, the stencil printing machine for performing a stencil printing process by pressing a printing paper on each printing drum and for disposing of a used stencil sheet from each printing drum, the control method comprising:

a step of controlling that a stencil disposal process and a stencil making process are not performed for the printing drum on which is mounted a stencil sheet for common printing data when there is designated the stencil printing process for plural printing data including said common printing data.

6. The stencil printing machine control method according to claim 5, wherein the operation of the stencil printing machine is so controlled that the common printing data is made on a stencil sheet mounted on the printing drum nearest to a paper feed section for feeding the printing paper.

7. A stencil printing machine having a plurality of printing drums, each printing drum having mounted thereon a stencil sheet made based on printing data for performing a stencil printing process by pressing a printing paper on each printing drum and disposing a used stencil sheet from other than a designated printing drum, the stencil printing machine comprising:

a mode designation section adapted to selectively designate each of the plurality of printing drums and which selectively designates one of the plurality of printing drums that perform the stencil printing process to which a stencil disposal process and a stencil making process are not performed; and a control section controlling operations of the stencil making process, the stencil disposal process, and the stencil printing process according to an instruction designated through the mode designation section, wherein the control section controls that the printing process is performed but that both the stencil disposal process and the stencil making process are not performed for the printing drum designated by the mode designation section.

8. A stencil printing machine control method of controlling operation of a stencil printing machine having a plurality of printing drums, each printing drum having mounted thereon a stencil sheet made based on data to be printed, and a mode designation section adapted to selectively designate each of the plurality of printing drums and which selectively designates one of the plurality of printing drums to which a stencil disposal process and a stencil making process are not performed, and performing a stencil printing process by pressing a printing paper on each printing drum and disposing a used stencil sheet from other than the designated printing drum, the stencil printing control method comprising:

designating one of the plurality of printing drums that perform the stencil printing process to which both a stencil disposal process and a stencil making process are not performed, wherein the operation of the stencil printing machine is so controlled that both the stencil disposal process and the stencil making process are not performed for the printing drum designated by the above printing drum designation step.

* * * * *